US006645580B1

(12) United States Patent
Tsai

(10) Patent No.: US 6,645,580 B1
(45) Date of Patent: Nov. 11, 2003

(54) SOFT-SHELLED ORNAMENT

(76) Inventor: Jui-An Tsai, 3F-2, No. 1181, Sec. 1, Kuo Chi Rd., Tao Yuan Hsien (TW)

( * ) Notice: Subject to any disclaimer, the term of this patent is extended or adjusted under 35 U.S.C. 154(b) by 0 days.

(21) Appl. No.: 10/145,104

(22) Filed: May 15, 2002

(51) Int. Cl.[7] ..... A47G 33/04

(52) U.S. Cl. ..... 428/11; 428/13; 428/14; 40/406; 40/409

(58) Field of Search ..... 428/11, 13, 14; 40/406, 409, 410, 411; 446/267

(56) References Cited

U.S. PATENT DOCUMENTS 6,061,937 A * 5/2000 Meng ..... 40/409
6,145,227 A * 11/2000 Liao ..... 40/406
6,269,566 B1 * 8/2001 Lo ..... 40/406
6,318,010 B1 * 11/2001 Tsai ..... 40/406

* cited by examiner

*Primary Examiner*—Deborah Jones
*Assistant Examiner*—Abraham Bahta
(74) *Attorney, Agent, or Firm*—Dennison, Schultz & Dougherty

(57) ABSTRACT

A soft-shelled ornament includes a transparent soft shell being clamped along an annular flange between a hold-down ring and a seat. The hold-down ring and the seat are tightly sealed into an integral unit by way of supersonic welding along two heat-sealing lines correspondingly provided at their contact surfaces. The hold-down ring and the seat are also provided at the contact surfaces radially inside said heat-sealing lines with two corresponding annular recesses for tightly receiving a leak-proof rubber ring therebetween. A flexible rubber plate is connected to the seat to bear against and close an inner end of a fluid inlet provided on the seat, so that a fluid is allowed to flow into but not out of the soft shell via the fluid inlet.

3 Claims, 5 Drawing Sheets

SOFT-SHELLED ORNAMENT

BACKGROUND OF THE INVENTION

The present invention relates to a soft-shelled ornament, and more particularly to a soft-shelled ornament that has simplified structure and can be more easily assembled and filled with a fluid as compared with other conventional similar ornaments.

A soft-shelled ornament is also referred to as a soft water ball ornament. It uses thermoplastic plastics or other similar materials to replace the fragile glass material in forming the ball portion of conventional ornamental crystals. There are some important aspects in producing the soft-shelled ornament, including the assembling of different parts of the ornament, the filling of a desired fluid into the ornament, and the leak-proof ability of the completed ornament.

SUMMARY OF THE INVENTION

A primary object of the present invention is to provide a soft-shelled ornament that has simplified structure to enable easy assembling of different parts of the ornament and good leak-proof ability of the completed ornament.

To achieve the above and other objects, the soft-shelled ornament of the present invention mainly includes a soft shell having an annular flange radially outward projected from an opening of the soft shell by a predetermined distance. The annular flange is clamped between a hold-down ring and a seat with a portion thereof being tightly held by a leak-proof rubber ring to and between two annular recesses correspondingly provided on contact surfaces of the hold-down ring and the seat. The seat is provided at a bottom with a fluid inlet, an inner end of which is closed with a flexible rubber plate that can be lifted only in an inward direction to serve as a check valve, so that the fluid can flow into but not out of the soft shell via the fluid inlet.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 2:
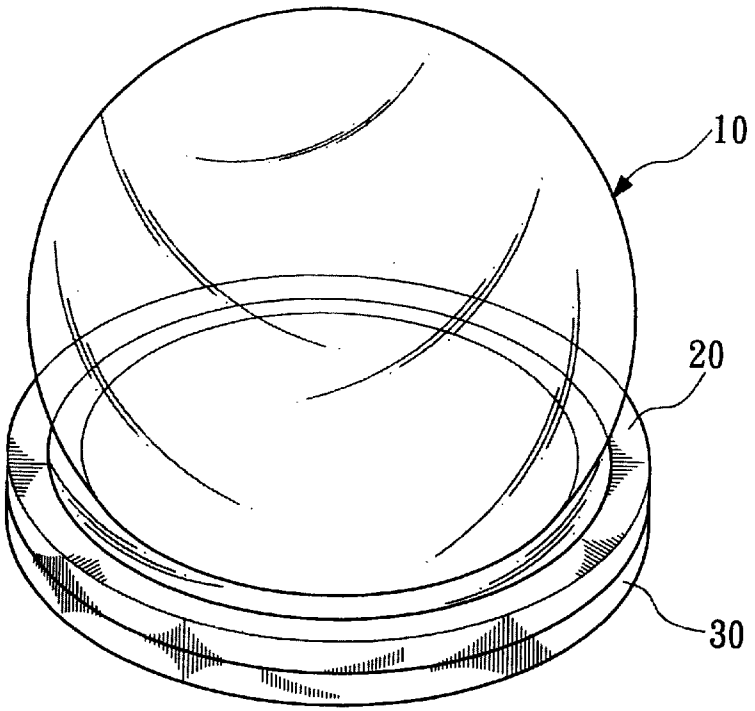
FIG. 2 shows the soft-shelled ornament of FIG. 1 having been fully pressure-filled with a fluid.
Figure 1:
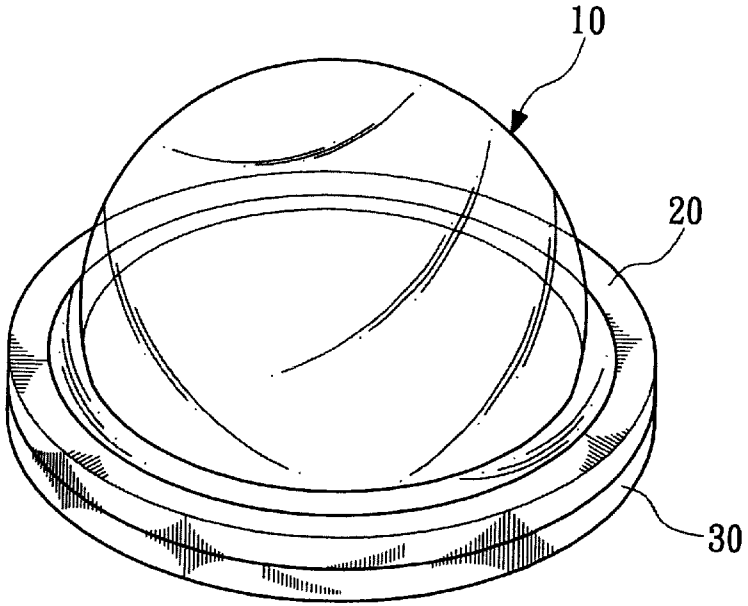
FIG. 1 is a perspective view of a soft-shelled ornament according to an embodiment of the present invention before being fully pressure-filled with a fluid.

Please refer to FIGS. 1 to 5 at the same time, in which a soft-shelled ornament according to a first embodiment of the present invention is shown. As shown, the soft-shelled ornament mainly includes a transparent soft shell 10, a hold-down ring 20, and a seat 30.

The soft shell 10 is a thin and soft plastic film formed by injection molding of a thermoplastic plastics or other similar materials under a high pressure and is therefore more changeful in shape and tougher in quality as compared with other non-injection-molded soft shells. This allows the soft shell 10 to be pressure-filled with a fluid to an ideally expanded state.

When the soft shell 10 is injection-molded, an opening 11 thereof is formed of a radially outward projected annular flange 12 having a predetermined width. The annular flange 12 is shaped and dimensioned corresponding to the hold-down ring 20 and the seat 30, so that it can be firmly clamped between the hold-down ring 20 and the seat 30.

The hold-down ring 20 and the seat 30 are provided at their contact surfaces with two corresponding heat-sealing lines 21, 31, that may be, for example, an annular groove and an annular tongue, respectively, so that the hold-down ring 20 and the seat 30 can be heat-sealed at the heat-sealing lines 21, 31 into an integral unit by way of supersonic working. The heat-sealing lines 21, 31 shown in FIGS. 4 and 5 have not been heat-sealed yet. When the heat-sealing lines 21, 31 are completely heat-sealed, they are molten into an integral body and a clearance between the hold-down ring 20 and the seat 30 is compressed to a tightest state. There are also two annular recesses 22, 32 in a predetermined depth vertically correspondingly formed on the contact surfaces of the hold-down ring 20 and the seat 30 at a radially inner side of the heat-sealing lines 21, 31 for together tightly receiving a leak-proof rubber ring 40 between them when the hold-down ring 20 and the seat 30 are heat-sealed by way of supersonic welding. With the rubber ring 40 tightly clamped between the two annular recesses 22, 32, the annular flange 12 of the soft shell 10 is tightly clamped between the hold-down ring 20 and the seat 30 in a leak-proof manner.

Figure 3:
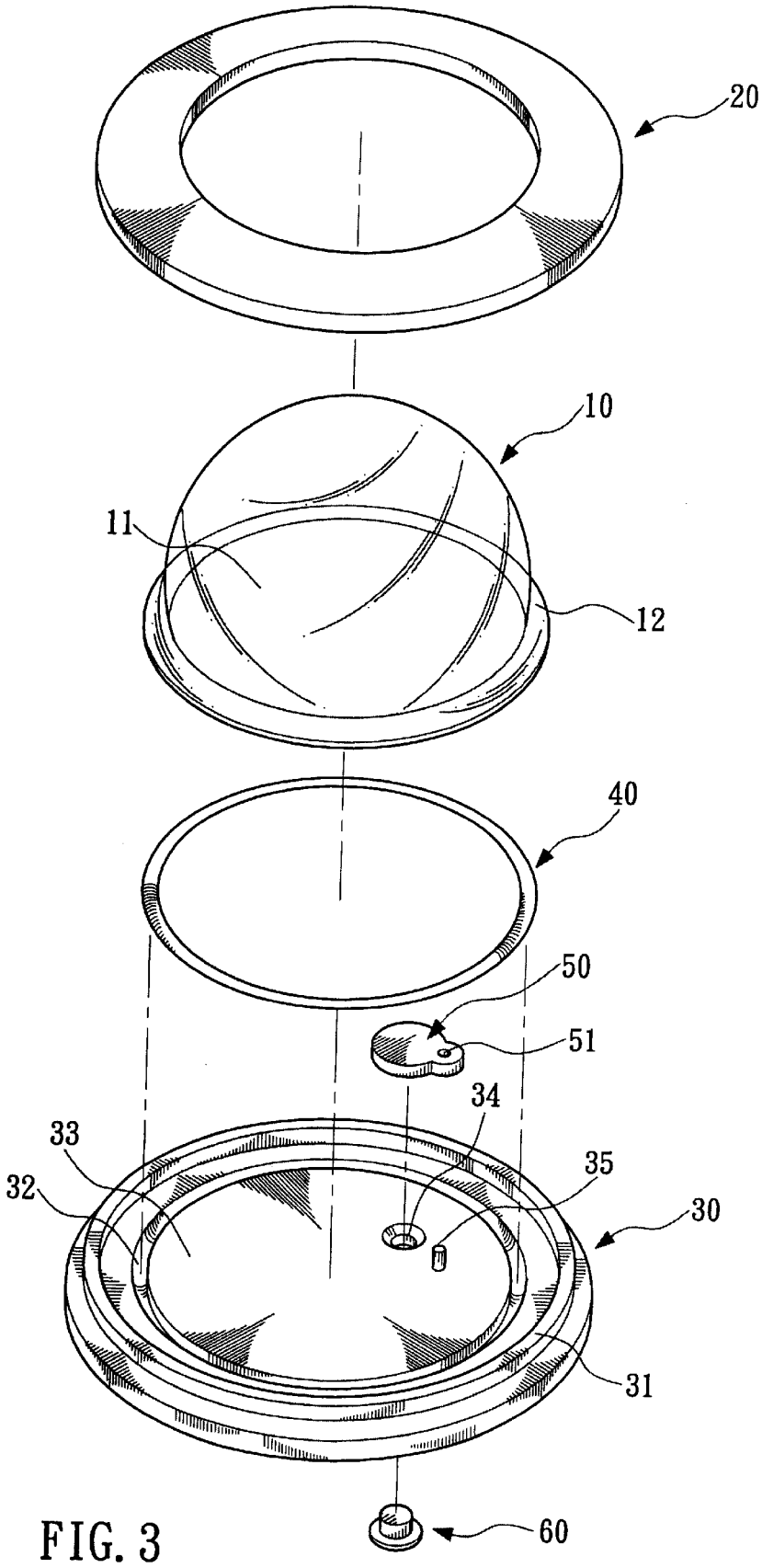
FIG. 3 is an exploded perspective view of the soft-shelled ornament of FIG. 1.
Figure 4:
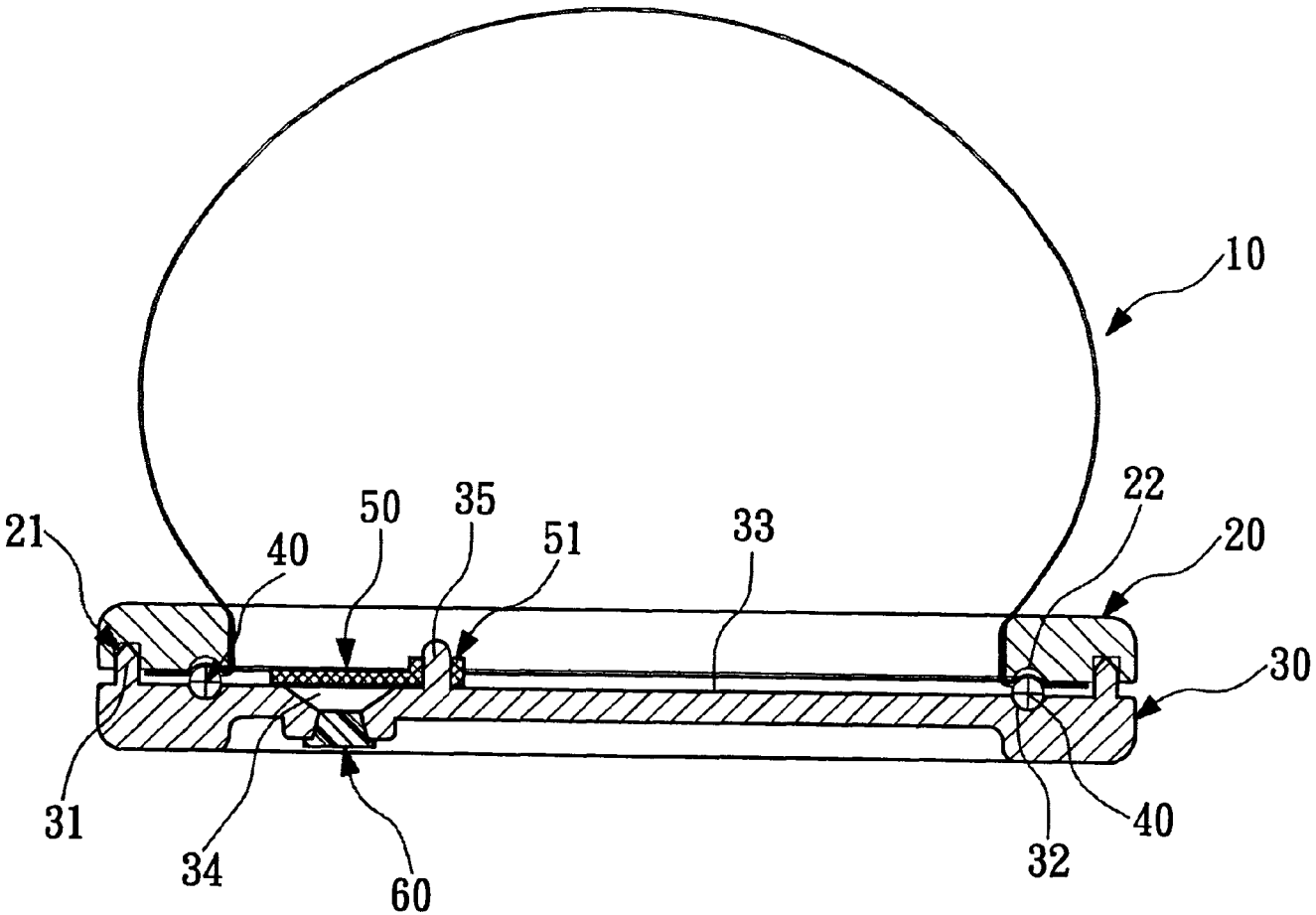
FIG. 4 is a sectioned side view of FIG. 1.
Figure 5:
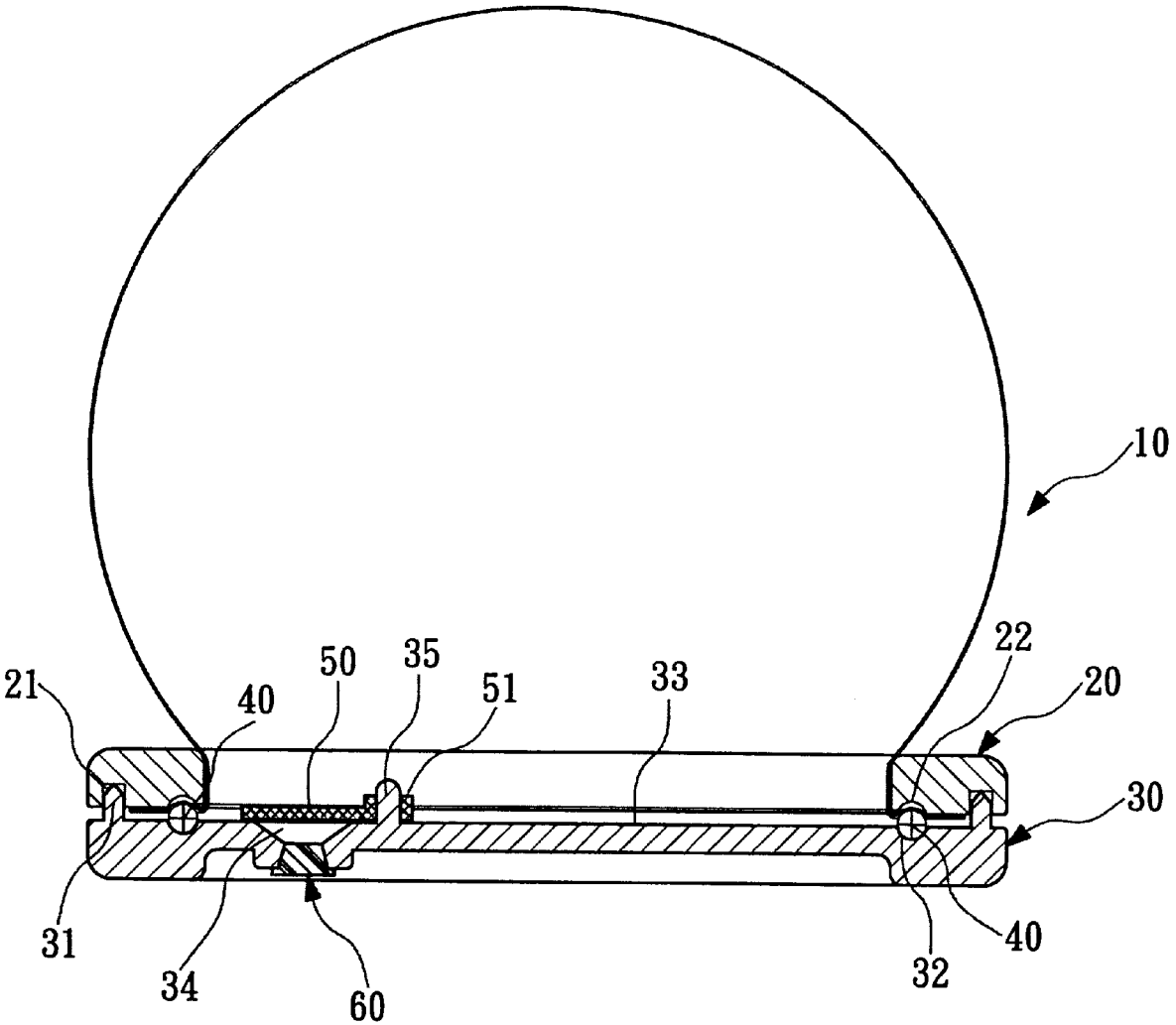
FIG. 5 is a sectioned side view of FIG. 2.

As can be seen in FIG. 3, the seat 30 is provided at a bottom surface 33 with a fluid inlet 34 and a fixing bar 35. The fixing bar 35 inward projects from an inner side of the bottom surface 33 and is located near an inner end of the fluid inlet 34. A flexible rubber plate 50 in predetermined shape and dimensions is connected at a hole 51 provided at one end thereof to the fixing bar 35, so that the fluid inlet 34 is located below and completely covered by the flexible rubber plate 50. It is noted that the rubber plate 50 functions like a check valve and can be lifted inward to allow the pressure-filled fluid to flow in only one direction from an outer side into the soft shell 10 via the fluid inlet 34. When the soft shell 10 is gradually filled with the fluid to expand from the state shown in FIG. 4 to the state shown in FIG. 5, a pressure from the filled fluid pushes the flexible rubber plate 50 to tightly bear against the inner end of the fluid inlet 34 and function as a good leak-proof member at the fluid inlet 34.

To assemble the soft-shelled ornament of the present invention, first connect the flexible rubber plate 50 to the fixing bar 35 to completely cover the fluid inlet 34, and position the rubber ring 40 in the annular recess 32 on the seat 30, and then put the soft shell 10 above the seat 30 with the annular flange 12 flatly seated on the rubber ring 40. Decorations, such as three-dimensional floatable articles or metallic chips, may be positioned on the seat 30 inside the soft shell 10 beforehand. Thereafter, put the hold-down ring 20 from a top of the soft shell 10 onto the seat 30 to engage the heat-sealing 21 of the hold-down ring 20 with the heat-sealing line 31 of the seat 30, and heat-seals the hold-down ring 20 and the seat 30 along the engaged heat-sealing lines 21, 31 by way of supersonic welding. Finally, use a fluid injection device, such as a syringe, to inject a desired fluid into the soft shell 10 via the fluid inlet 34 under a suitable pressure. The desired fluid may be liquid or jelly-like substance. When the pressure-filled fluid gradually expands the soft shell 10 to a predetermined degree, extract the injection device from the fluid inlet 34 and stop injecting. At this point, the flexible rubber plate 50 automatically closes the fluid inlet 34 from inside of the soft shell 10, preventing any filled fluid from leaking via the fluid inlet 34. A plug 60 may be fitted in an outer end of the fluid inlet 34 to seal the same, lest the flexible rubber plate 50 should be pierced through by a foreign matter via the fluid inlet 34.

Figure 7:
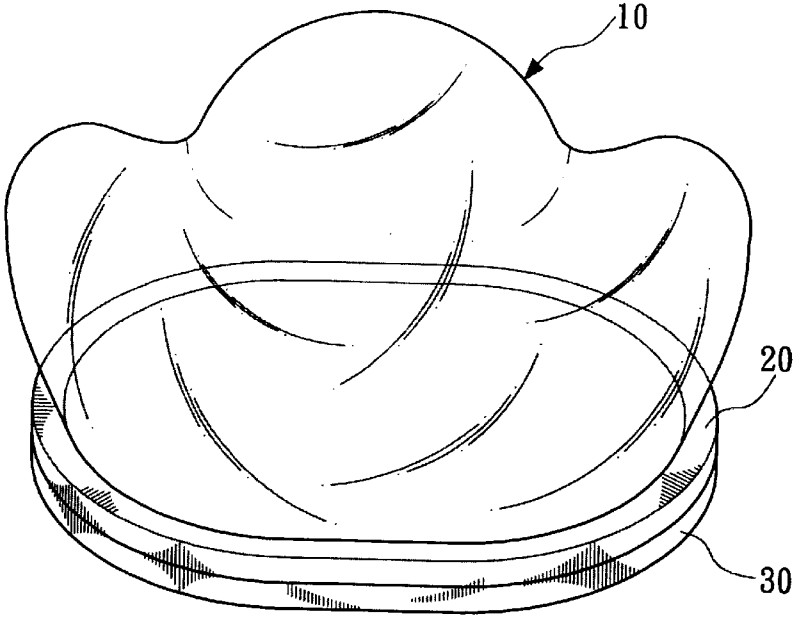
FIG. 7 shows the soft-shelled ornament of FIG. 6 having been fully pressure-filled with a fluid.
Figure 6:
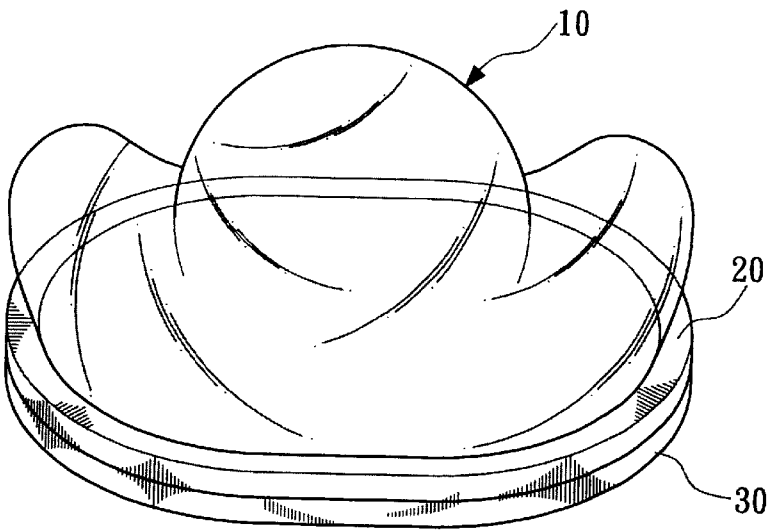
FIG. 6 is a perspective view of a soft-shelled ornament according to another embodiment of the present invention before being fully pressure-filled with a fluid.

The soft shell 10, the hold-down ring 20, and the seat 30 are not necessarily limited to any specific shape, so long as the annular flange 12 of the soft shell 10 has a shape corresponding to that of the hold-down ring 20 and the seat 30 and the annular recesses 22, 32 having the same shape are provided to tightly hold the rubber ring 40 between them to ensure a leak-proof contact of the soft shell 10 at the flange 12 with the hold-down ring 20 and the seat 30. FIGS. 6 and 7 show a soft-shelled ornament according to another embodiment of the present invention before and after the soft shell is fully filled with a fluid, respectively.

What is claimed is:

1. A soft-shelled ornament, comprising a soft shell, a hold-down ring, and a seat;

said soft shell being a soft plastic film made of a thermoplastic plastics by way of high-pressure injection molding and being expandable with a pressure-filled fluid, said soft shell including a radially outward projected annular flange formed around an opening of said soft shell and having a predetermined width, and said annular flange having a shape corresponding to that of said hold-down ring and said seat to be tightly clamped between said hold-down ring and said seat;

said hold-down ring including a contact surface with a first annular heat-sealing line and a first annular recess located at a radially inner side of said first annular heat-sealing line; a leak-proof rubber ring and said first annular recess having a predetermined depth for receiving said leak-proof rubber ring therein; and said seat including a contact surface for contacting said contact surface of said hold-down ring with a second annular heat-sealing line corresponding to said first annular heat-sealing line on said hold-down ring, and a second annular recess located at a radially inner side of said second annular heat-sealing line and corresponding to said first annular recess on said hold-down ring to hold said leak-proof rubber ring between said first and said second annular recesses; said seat also including a fluid inlet, and a fixing bar projected from an inner side of said bottom surface adjacent to said fluid inlet; a flexible rubber plate connected to said fixing bar to bear against and completely cover an inner end of said fluid inlet, such that said flexible rubber plate can be lifted only in an inward direction to allow a fluid to flow into but not out of said soft shell via said fluid inlet; and said soft-shelled ornament being assembled by connecting said flexible rubber plate to said fixing bar to completely cover said inner end of said fluid inlet and positioning said rubber ring in said second annular recess on said seat, putting said soft shell above said seat with said annular flange flatly seated on said rubber ring, putting said hold-down ring from a top of said soft shell onto said seat, heat-sealing said soft shell, said hold-down ring, and said seat into an integral unit by way of supersonic welding along said first and said second heat-sealing lines, and finally, injecting a desired fluid into said soft shell via said fluid inlet under a predetermined pressure to expand said soft shell to a predetermined degree.

2. The soft-shelled ornament as claimed in claim 1, further comprising a plug removably connected to an outer end of said fluid inlet.

3. The soft-shelled ornament as claimed in claim 1, wherein decorative articles are disposed in said soft shell before said first and said second heat-sealing lines are connected to each other through supersonic welding.

* * * * *